United States Patent [19]

Artwick et al.

[11] Patent Number: 4,920,718

[45] Date of Patent: May 1, 1990

[54] INTEGRAL DOOR LIGHT AND RELATED DOOR CONSTRUCTION

[75] Inventors: Kert E. Artwick, Holland; Steven R. Wilkening, Wyoming, both of Mich.

[73] Assignee: ODL, Incorporated, Zeeland, Mich.

[21] Appl. No.: 346,246

[22] Filed: May 1, 1989

Related U.S. Application Data

[63] Continuation of Ser. No. 169,610, Mar. 17, 1988, abandoned.

[51] Int. Cl.[5] ..... E06B 3/54

[52] U.S. Cl. ..... 52/476; 52/403; 52/455; 52/475; 52/656

[58] Field of Search ..... 52/455, 456, 457, 458, 52/474, 475, 476, 821, 822, 824, 825, 826, 827, 403, 656; 49/501, 504

[56] References Cited

U.S. PATENT DOCUMENTS

| | | | |
|---|---|---|---|
| 557,148 | 3/1896 | Rapp . | |
| 809,145 | 1/1906 | Sjobring . | |
| 986,013 | 3/1911 | Klemm . | |
| 988,574 | 4/1911 | Jones . | |
| 998,620 | 7/1911 | Leonard | 52/455 |
| 1,000,094 | 8/1911 | Klemm . | |
| 1,009,089 | 11/1911 | Nellis . | |
| 1,021,053 | 3/1912 | Lempera . | |
| 1,039,292 | 9/1912 | Johnson . | |
| 1,124,660 | 1/1915 | Rapp . | |
| 1,150,132 | 8/1915 | Lempera . | |
| 1,185,705 | 6/1916 | Nyman . | |
| 1,203,311 | 10/1916 | Connell . | |
| 1,270,014 | 6/1918 | Conwell . | |
| 1,391,949 | 9/1921 | Gogay . | |
| 1,466,650 | 8/1923 | Peterson . | |
| 1,574,493 | 2/1926 | Leonard . | |
| 1,601,519 | 9/1926 | Young . | |
| 1,620,451 | 3/1927 | Ellison et al. . | |
| 1,808,414 | 6/1931 | Hurley et al. | 49/501 |
| 1,857,076 | 5/1932 | Zenker . | |
| 2,336,999 | 12/1943 | Peelle | 189/46 |
| 2,605,869 | 8/1952 | Backman | 189/53 |
| 2,670,507 | 3/1954 | Daitch et al. | 52/455 |
| 2,710,994 | 6/1955 | Mills | 20/56.5 |
| 2,747,705 | 5/1956 | Bagnard | 189/46 |
| 3,004,641 | 10/1961 | Johnson | 189/46 |
| 3,096,861 | 7/1963 | Frick et al. | 189/34 |
| 3,153,817 | 10/1964 | Pease, Jr. | 20/35 |
| 3,177,533 | 4/1965 | Davis | 52/475 |
| 3,205,630 | 9/1965 | Felix et al. | 52/476 |
| 3,245,124 | 4/1966 | Faske | 20/11 |
| 3,299,596 | 1/1967 | Neal et al. | 52/476 |
| 3,458,955 | 8/1969 | Brooks | 49/382 |
| 3,462,897 | 8/1969 | Weinrott | 52/169 |
| 3,487,602 | 1/1970 | Braun et al. | 52/455 |
| 3,490,178 | 1/1970 | Voisin | 49/489 |
| 3,503,166 | 3/1970 | Nakazawa | 52/475 |
| 3,576,092 | 4/1971 | Halpern | 52/456 |
| 3,697,633 | 10/1972 | Edgar | 264/45 |
| 3,750,358 | 8/1973 | Lekowitz | 52/475 |
| 3,903,669 | 9/1975 | Pease, Jr. et al. | 52/455 |
| 4,084,347 | 4/1978 | Brown | 49/397 |
| 4,084,361 | 4/1978 | Aspaas | 52/204 |
| 4,087,950 | 5/1978 | Nagase | 52/475 |
| 4,152,876 | 5/1979 | Seely | 52/455 |
| 4,241,556 | 12/1980 | Bursk | 52/455 |
| 4,246,731 | 1/1981 | Miro | 52/656 |
| 4,266,487 | 5/1981 | Marulic et al. | 105/397 |
| 4,327,535 | 5/1982 | Governale | 52/309.11 |
| 4,413,397 | 11/1983 | McKann | 29/416 |
| 4,430,836 | 2/1984 | McKann | 52/455 |
| 4,524,978 | 6/1985 | Mauser | 52/824 |
| 4,546,585 | 10/1985 | Governale | 52/309.11 |
| 4,550,542 | 11/1985 | La See | 52/455 |

FOREIGN PATENT DOCUMENTS

| | | | |
|---|---|---|---|
| 2258510 | 8/1975 | France . | |
| 633223 | 2/1962 | Italy | 52/475 |

*Primary Examiner*—Michael Safavi

*Attorney, Agent, or Firm*—Warner, Norcross & Judd

[57] ABSTRACT

The specification discloses a door assembly having a flush-mounted integral door light supported on a perimeter lip extending from the door. The door light includes inner and outer frames sandwiching a panel and the perimeter lip therebetween. The outer frame includes compressive weather seals against both the panel and the lip. The door rails and stiles each include an ear along one side thereof to provide both a tenon-and-mortise construction and the perimeter lip about the door opening.

37 Claims, 6 Drawing Sheets

FIG. 4
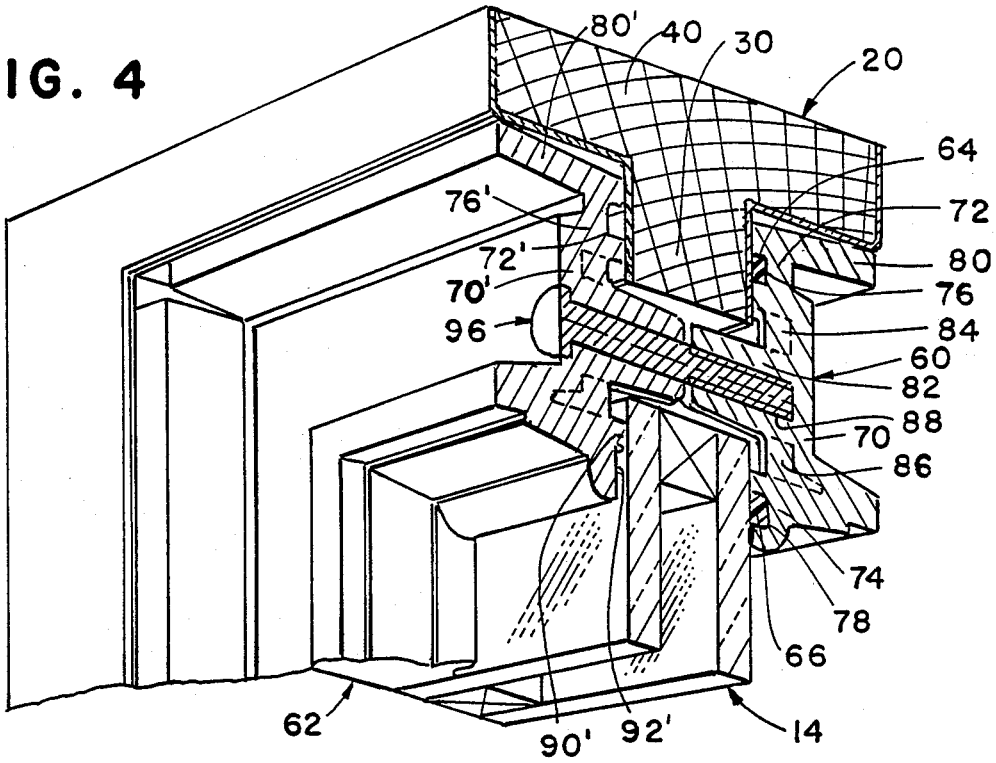
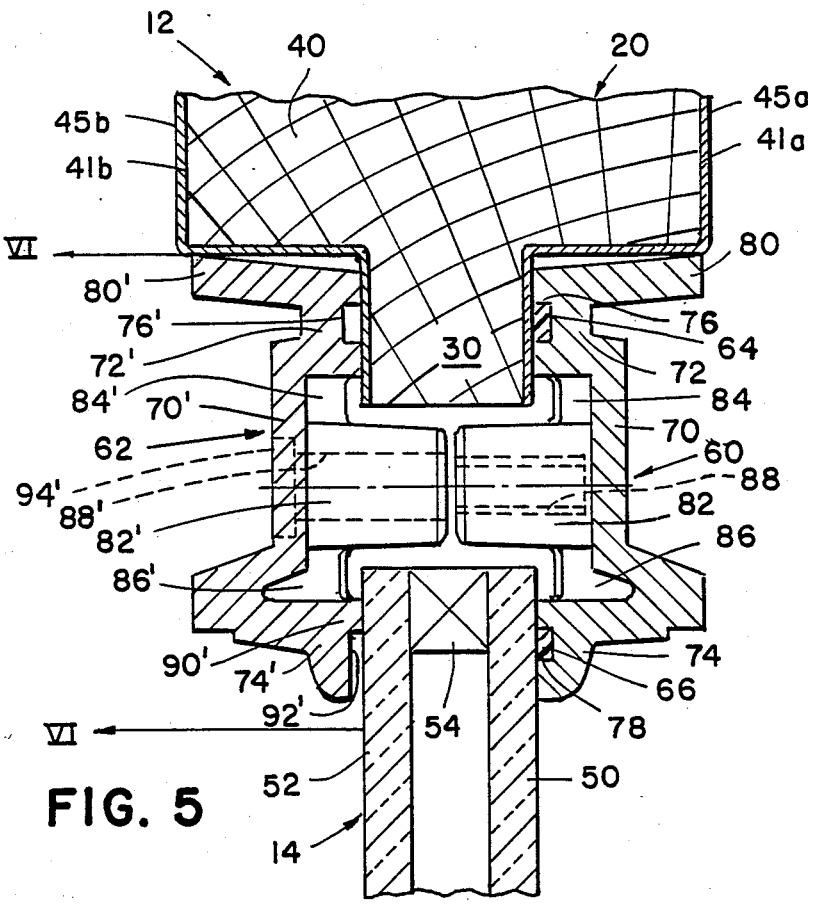
FIG. 5
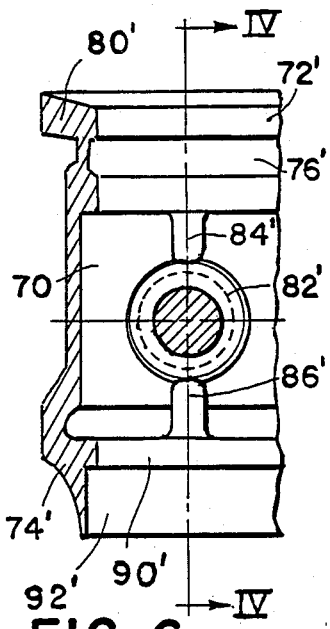
FIG. 6

FIG. 7
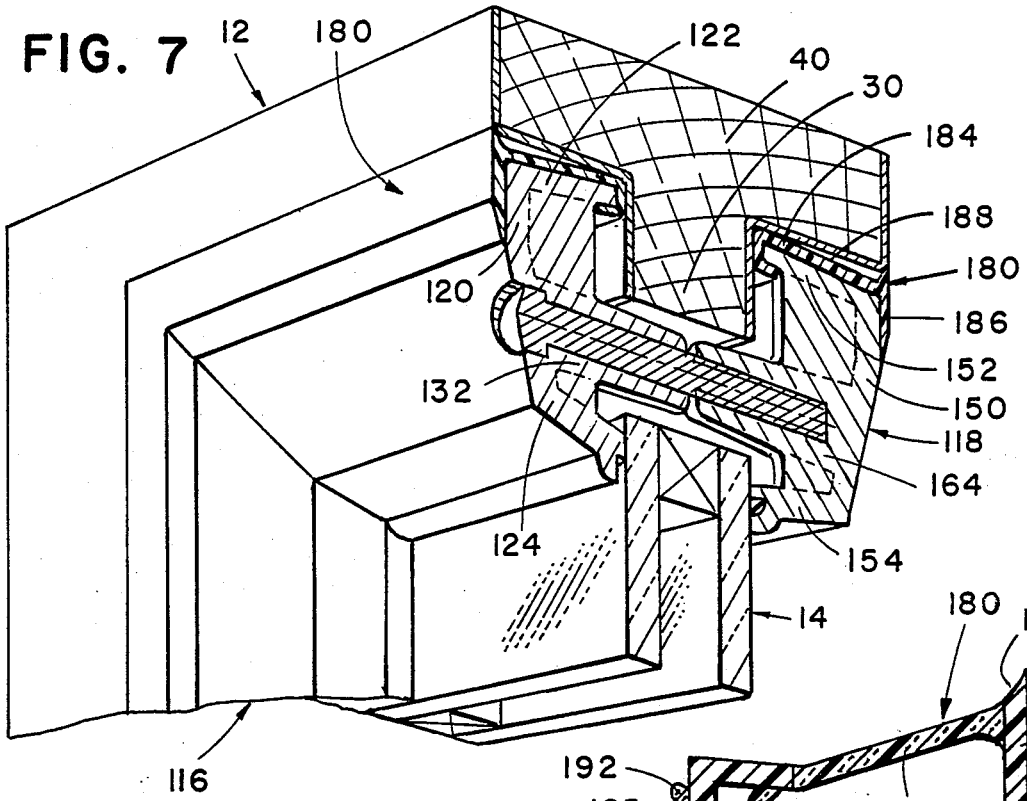
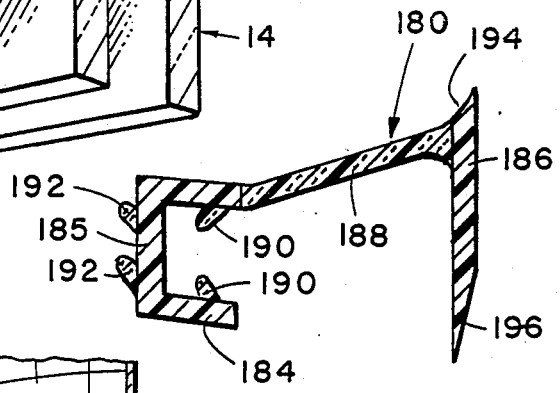
FIG. 9
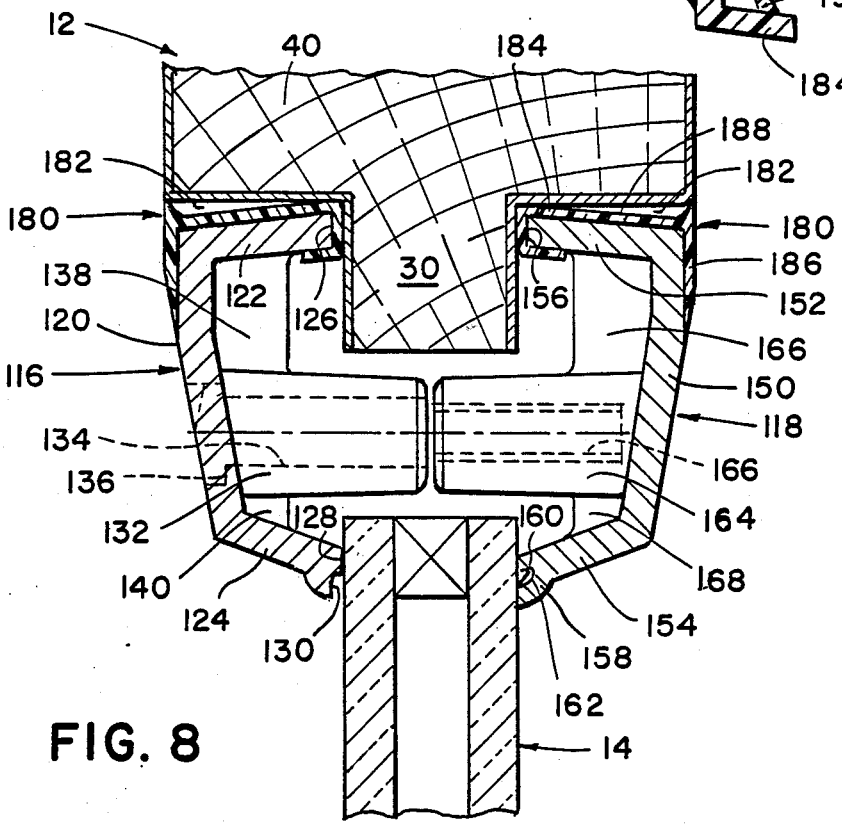
FIG. 8

FIG. 10
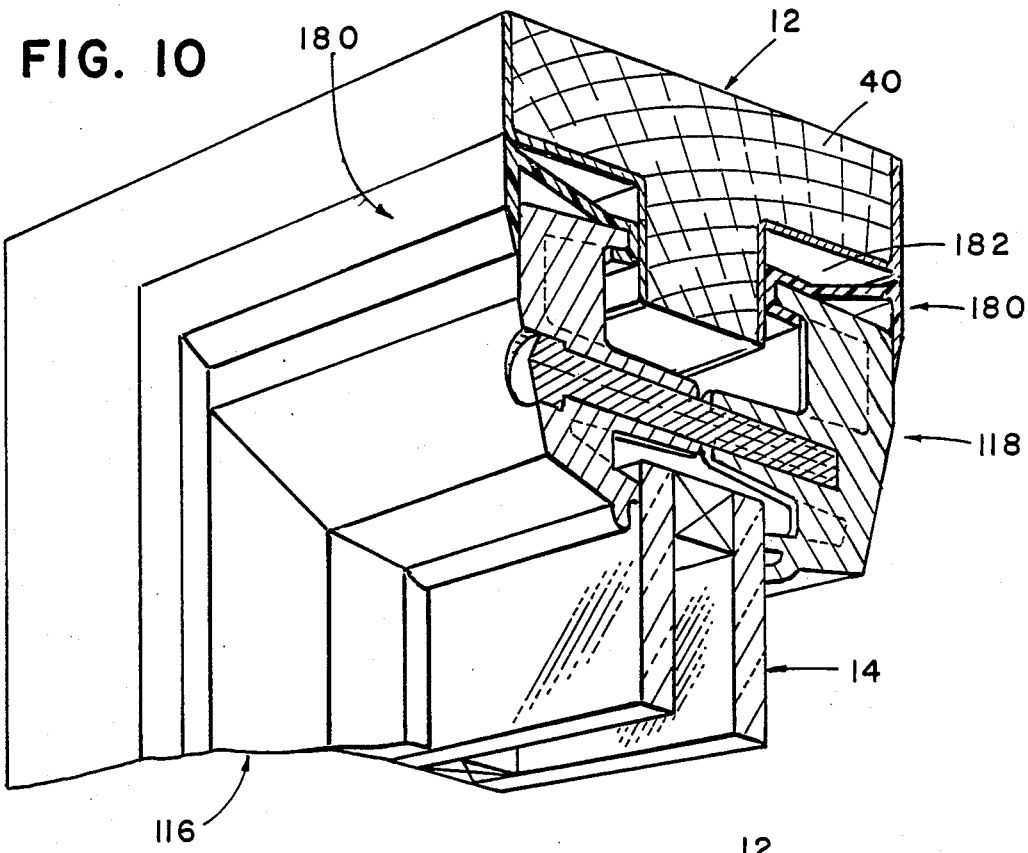
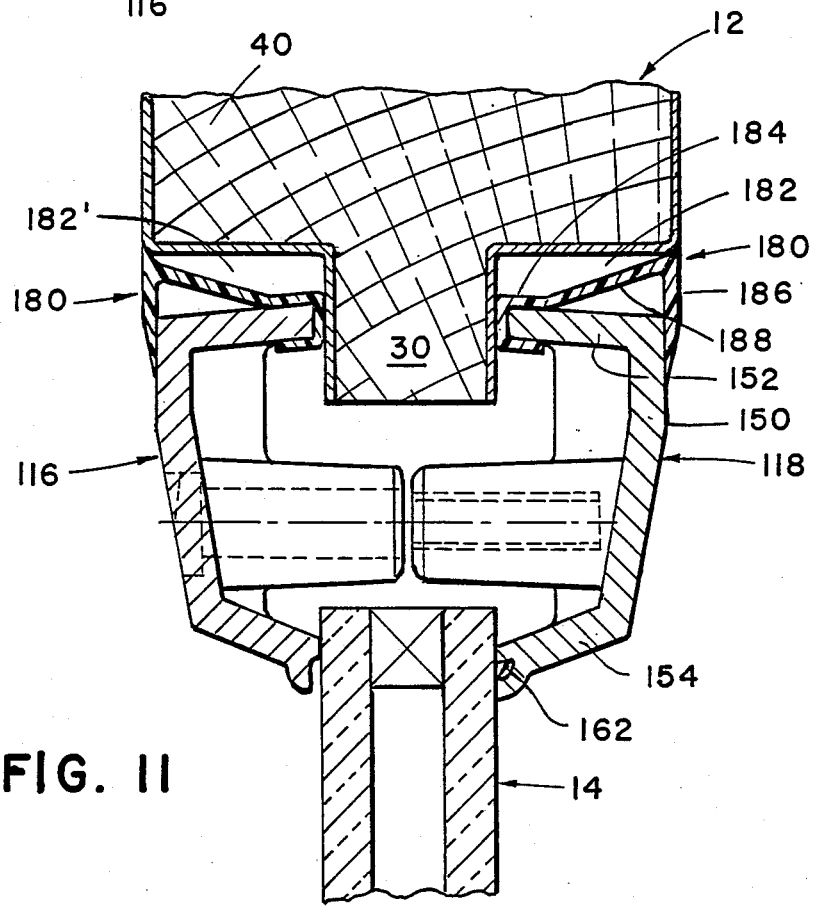
FIG. 11

FIG. 12
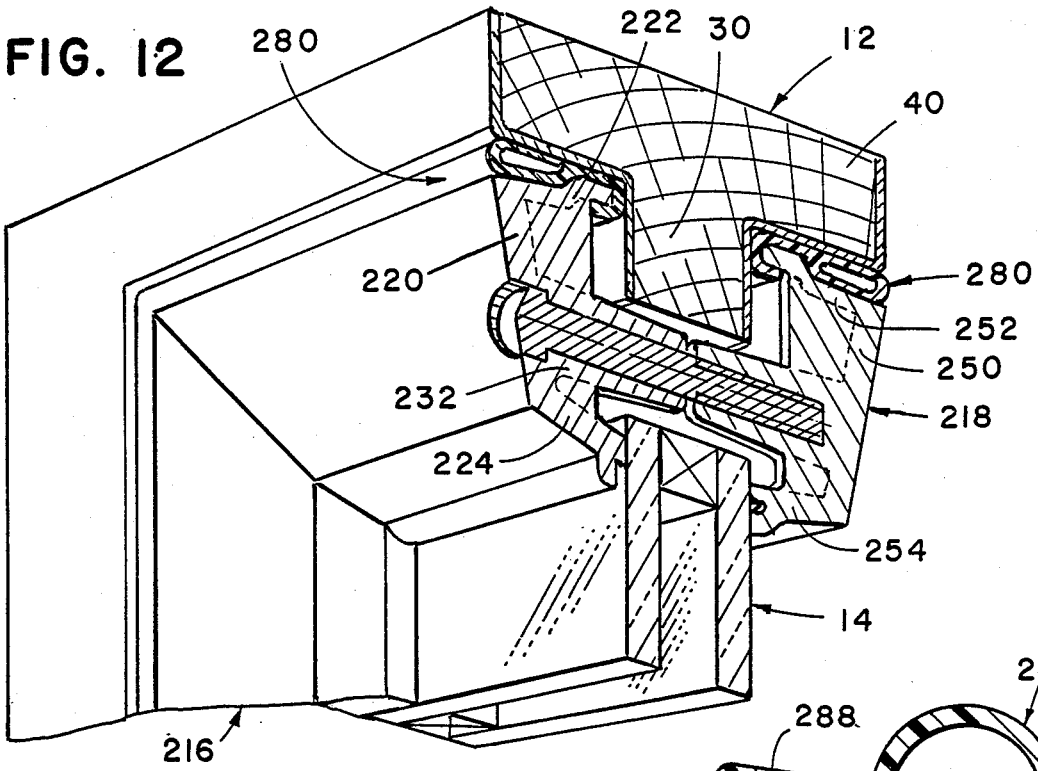
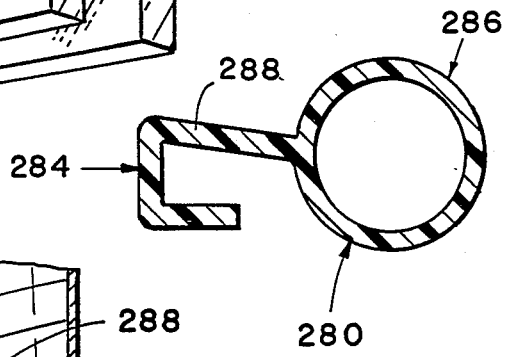
FIG. 14
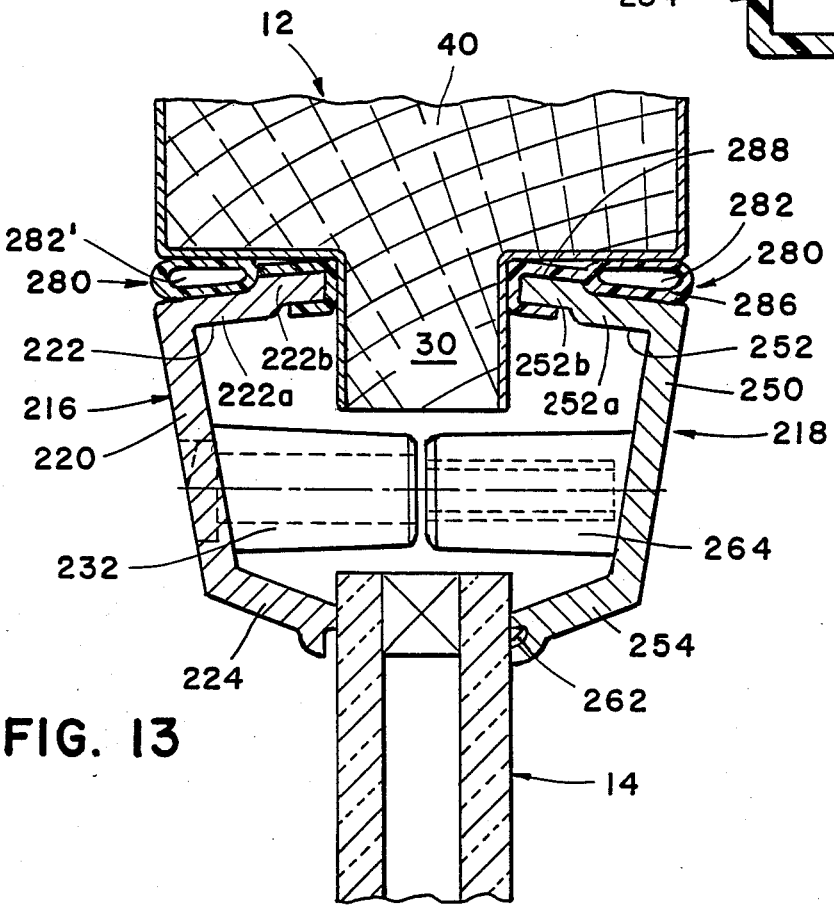
FIG. 13

FIG. 15
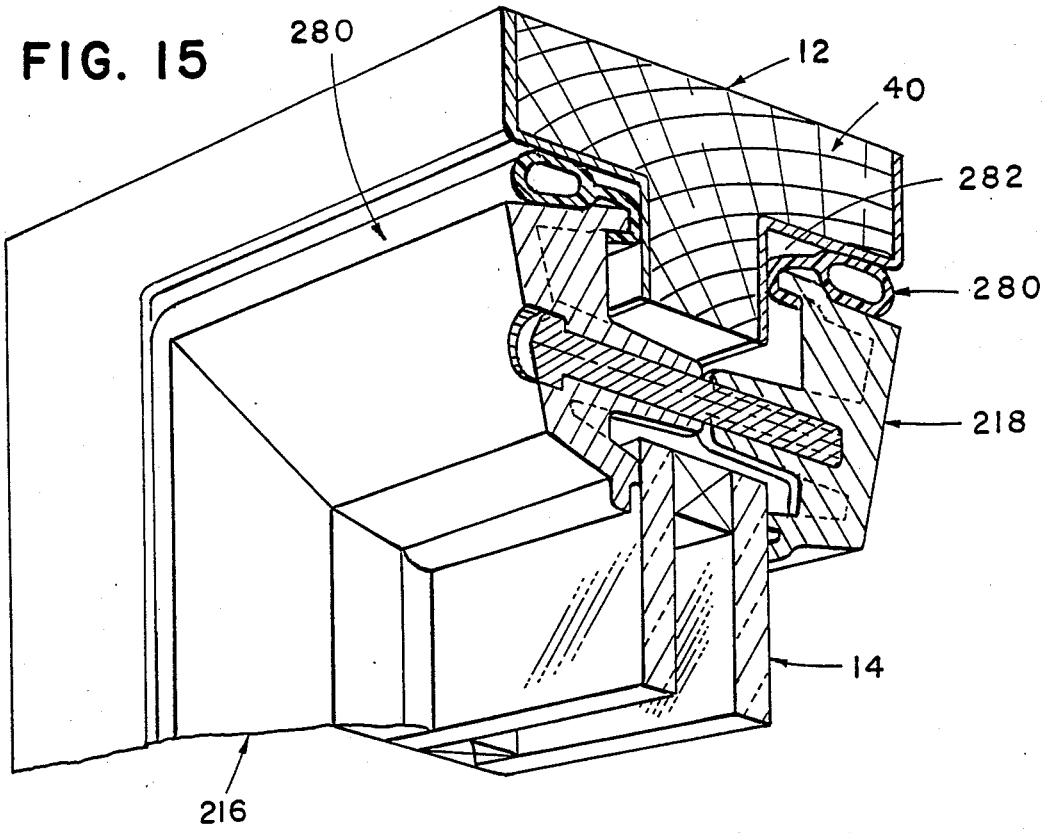
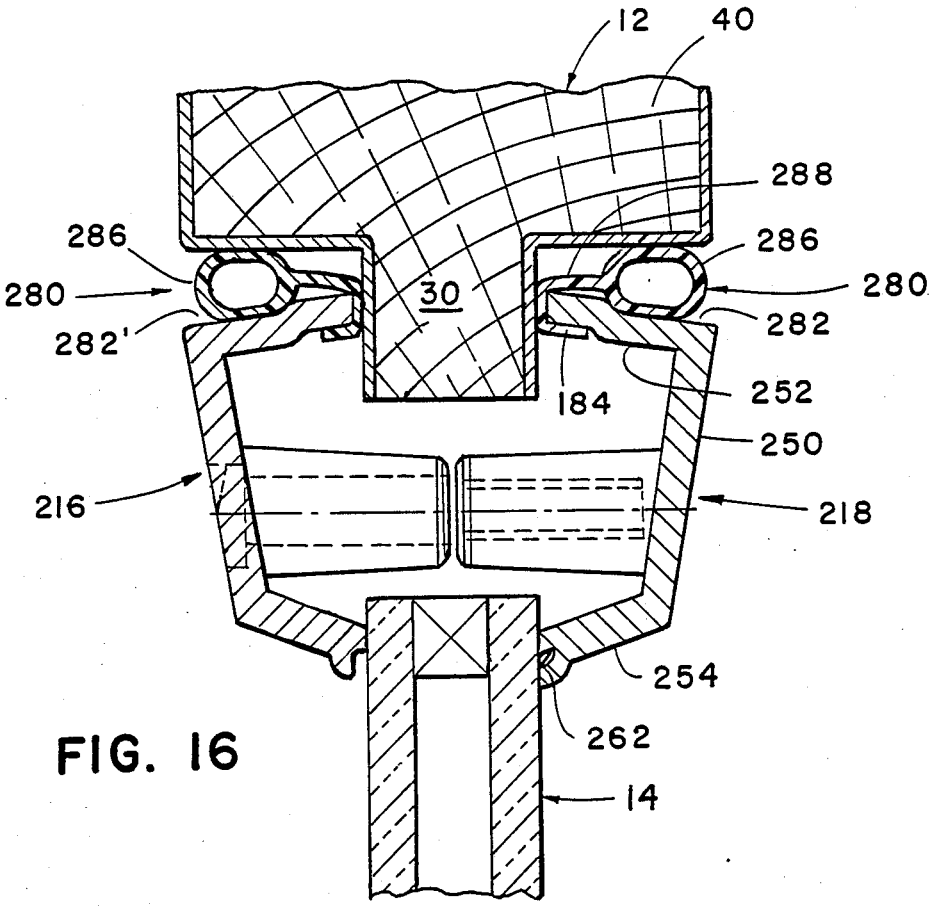
FIG. 16

INTEGRAL DOOR LIGHT AND RELATED DOOR CONSTRUCTION

This is a continuation of co-pending application Ser. No. 07/169,610, filed on Mar. 17, 1988 now abandoned.

BACKGROUND OF THE INVENTION

The present invention relates to door lights, and more specifically to fixed, flush-mounted integral door lights.

A great many door-light constructions have been developed for mounting one or more glass panels within a door. Generally speaking, door lights are of two types—vented or fixed. In a vented door light, one of the glass panels is mounted for sliding movement enabling ventilation through the door. In a fixed door light, the glass panel or panels are stationarily mounted within the door. The present invention relates to fixed door lights.

Recently, fixed door lights have become increasingly popular because of the widespread acceptance of the "patio door". Generally speaking, the patio door is a substitute for the conventional sliding door and has a hinged rather than sliding movement. The door light extends substantially the full height and width of the door with only a relatively narrow rail and stile frame supporting the light. The patio door is typically more energy efficient than a sliding door because air infiltration seals are more effective in hinged doors than in sliding doors.

Fixed door-light constructions have been developed which are specifically for or adaptable to patio doors. Two such constructions are illustrated in U.S. Pat. Nos. 4,430,836, issued Feb. 14, 1984 to McKann and entitled FRAME ASSEMBLY FOR DOOR LIGHT, and 4,413,397, issued Nov. 8, 1983 to McKann entitled METAL DOOR AND LIGHT ASSEMBLY (both apparently owned by General Products Co., Inc. of Fredricksburg, Va.). Both patents disclose a door assembly having a fixed door light supported in the door by a rather complicated frame assembly. Two identical frame halves are installed from opposite sides of the door to entrap the glass panel therebetween. Each frame half is generally U-shaped including a facing portion, a glass-engaging leg extending from the facing portion, and a locator leg also extending from the facing portion. The steel door skins extend inwardly toward one another at the door-light opening and terminate in tabs which extend away from the core of the door approximately midway between the two sides of the door. The locator legs on the frame halves engage these tabs to register or locate the assembly with respect to the door. The locator legs on the frame halves engage these tabs to register or locate the assembly with respect to the door. The glass-engaging legs engage opposite sides of the glass panel to support the panel within the opening. Caulking tape on the glass panel provides a seal between the frame halves and the panel. Although not specifically disclosed, it is believed that the commercial embodiment of this product additionally provides butyl glazing between each frame half and the adjacent steel door skin to provide a weather seal therebetween.

The McKann structure suffers several drawbacks. First, the necessity of applying butyl caulking between each frame half and the adjacent steel door skin complicates manufacture and therefore increases the cost of the door. Second, the thermally conductive metal frame halves require insulating blocks therebetween to provide a construction having an acceptable R-value. Third, a rather complicated fastening structure is required comprising plastic inserts and screws through both frame halves. This further complicates assembly and therefore increases the cost of the product. Finally, the frame assembly requires an excessive number of parts posing manufacturing, inventory, and servicing problems.

SUMMARY OF THE INVENTION

The aforementioned problems are overcome by the present invention which provides a fixed door light and related door structure wherein the door-light frame effects compressive weather seals against both the glass and a lip extending into the door opening about the entire perimeter of the opening. The glass panel is generally coplanar with the lip. Compression is effected by a pair of frames mounted from opposite sides of the door and secured together to simultaneously entrap the door lip and the glass panel. The compressive weather seals against both the glass panel and the door lip fully weather seal the glass within the door.

In selected embodiments, the door light further includes a seal for covering or sealing any gap between the door-light frame and the door. The seal enables greater manufacturing tolerances since any resultant gap is aesthetically covered by the seal. The increased manufacturing tolerance reduces the cost of the resultant door while still providing a structure which is aesthetically acceptable.

In some of the selected embodiments, the gap seal is integral with the compression seal between the door-light frame and the door. For example, both seals can be incorporated into an extrusion or coextrusion fitted about the door frame and extending into the gap area. This further simplifies the door construction with reduced manufacturing costs.

The preferred door includes a unique and novel structure providing the inwardly extending lip about the perimeter of the door opening. The door includes two vertical stiles and top and bottom rails extending between the stiles. Each vertical stile is substantially uniform in cross section throughout its height and includes a rectangular body portion and a rectangular ear extending therefrom. The rails are each also generally uniform in cross section including a rectangular body portion and a rectangular ear extending therefrom. The rails additionally include channels in their two opposite ends for receiving the ears from the stiles. The stile ears are fitted and secured within the rail channels to define a rectangular or other polygonal frame. The rail ears and stile ears together define a substantially continuous lip about the entire perimeter of the door opening. This construction is easily manufactured, is strong, and provides the desired continuous lip.

In a preferred embodiment of the second aspect of the invention, protective skins cover both opposite sides of the rails and stiles. Further, the skins are formed in the area of the lip to extend between the lip and door surfaces and also along the ear portion. Consequently, the compressive seal between the frame and the lip portion engages the steel skin and thereby prevents water from reaching the core of the door.

These and other objects, advantages, and features of the invention will be more readily understood and appreciated by reference to the detailed description of the preferred embodiment and the drawings.

BRIEF DESCRIPTION OF THE DRAWINGS

FIG. 4 is a fragmentary sectional perspective view of the assembly;

FIG. 5 is a sectional view through the assembly taken along a line not including the screw boss;

FIG. 6 is a fragmentary plan view of the door-light frame including the screw boss;

FIG. 7 is a fragmentary sectional perspective view of the assembly incorporating an alternate door-light frame;

FIG. 8 is a sectional view of the assembly including the alternate frame taken along a line not including the screw boss;

FIG. 9 is a sectional view through the gap seal of the alternate frame;

FIG. 10 is a fragmentary sectional perspective view similar to FIG. 7 but showing the door-light frames in a lower position with respect to the lip;

FIG. 11 is a fragmentary sectional view similar to FIG. 8 but showing the door-light frames in a lower position with respect to the lip;

FIG. 12 is a fragmentary sectional perspective view of the assembly incorporating a second alternate door-light frame;

FIG. 13 is a sectional view of the assembly including the second alternate frame taken along a line not including the screw boss;

FIG. 14 is a sectional view through the gap seal of the second alternate frame;

FIG. 15 is a fragmentary sectional perspective view similar to FIG. 12 but showing the door-light frames in a lower position with respect to the lip; and FIG. 16 is a fragmentary sectional view similar to FIG. 13 but showing the door-light frames in a lower position with respect to the lip.

DETAILED DESCRIPTION OF THE PREFERRED EMBODIMENTS

Figure 1:
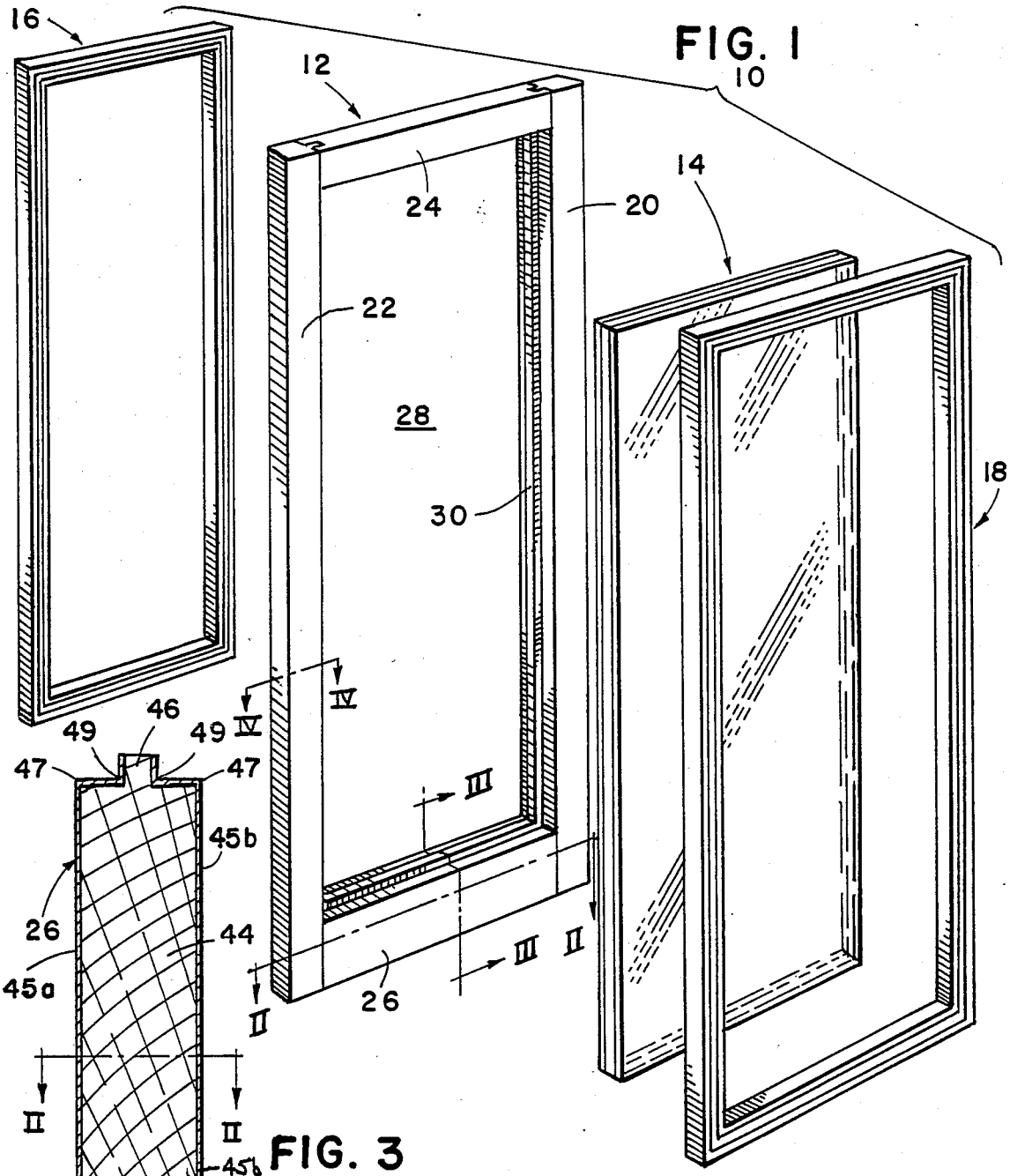
FIG. 1 is a perspective exploded view of the door and door-light assembly of the present invention.

Integral door lights and a related door construction are illustrated in the drawings; and the first embodiment of FIGS. 1–6 is generally designated 10. The assembly 10 includes a door 12, a glass panel 14, and inner and outer frames 16 and 18. The door 12 includes a pair of stiles 20 and 22 and top and bottom rails 24 and 26. The rails and stiles are interconnected in tenon-and-mortise fashion to define a rectangular or other polygonal opening 28 with an inwardly extending peripheral lip 30. The glass 14 is mounted within the opening 28 and preferably is coplanar with the lip 30. The inner and outer frames 16 and 18 are installed from opposite sides of the door to simultaneously entrap and compressively retain the lip 30 and the glass 14 in position.

I. Door Construction

Figure 3:
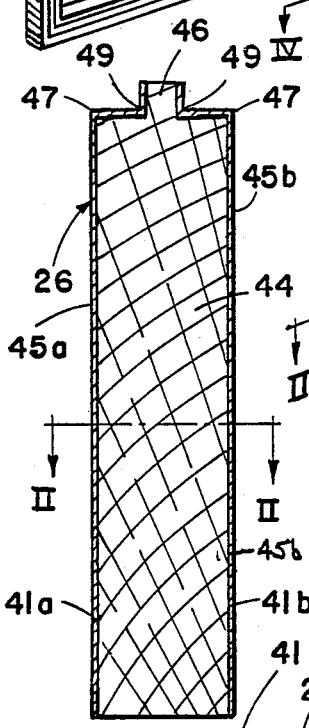
FIG. 3 is a sectional view of the bottom rail taken along line III—III in FIG. 1.
Figure 2:
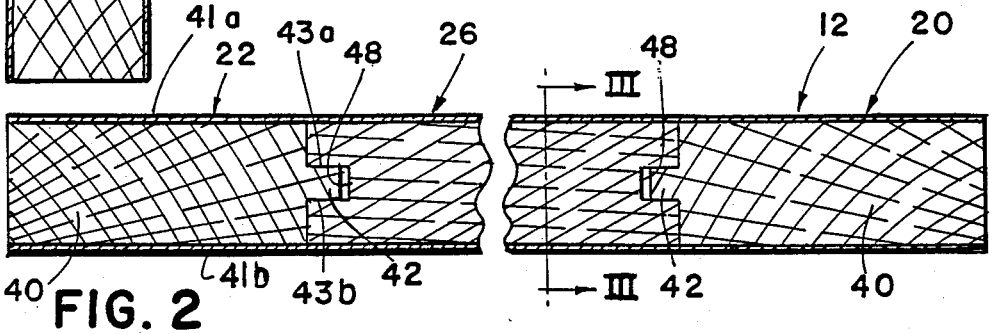
FIG. 2 is a sectional view taken along line II—II in FIG. 1.

The construction of door 12 is illustrated in greater detail in FIGS. 1–3 and, as noted above, includes a pair of stiles 20 and 22 interconnected by top and bottom rails 24 and 26.

Each of the stiles 20 and 22 (FIGS. 1 and 2) is generally identical to the other and is substantially uniform in vertical cross section throughout its length or height. In the present invention, it is immaterial which stile is designated the hinge stile, and which is designated the latch stile. Each stile is fabricated of a single piece of wood and includes a generally rectangular body portion 40 having opposite sides or surfaces 41 and a generally rectangular ear portion 42 having opposite sides or surfaces 43. The thickness of the ear 42 is approximately one-half the thickness of the stile body 40. Further, the ear 42 is centered on the width of the stile body 40 to be located generally midway through the opening 28. Consequently, the side of each ear is recessed from the associated side of the door.

The bottom rail 26 (FIGS. 1–3) is also generally uniform in cross section throughout its length except at its two opposite ends. As with the stiles, the bottom rail 26 includes a rectangular body portion 44 and a rectangular ear portion 46 extending therefrom. The ear portion 46 has a thickness approximately one-half that of the body portion 44 and substantially equal to the thickness of the stile ears 42. The ear portion 46 is located at the center of the thickness of the body portion 44 and is therefore centered within the opening 28. As illustrated in FIG. 1, the bottom rail ear 46 extends the full distance between the stile ears 42. A pair of vertical channels or grooves 48 are formed in the opposite ends of the bottom rail 26 and extend the full height of the rail to receive the stile ears 42. The width of the channel 48 is substantially identical to the thickness of the stile ears 42 to closely receive the ears therein. The bottom rail ear portion 46 terminates at both grooves 48 at its opposite ends.

The top rail 24 (FIG. 1) is generally similar to bottom rail 26. The only difference between the top rail 24 and the bottom rail 26 is that the height of the top rail body portion is less than the height of the bottom rail body portion 44. Such differences in height are typical in door constructions.

The stiles 20 and 22 are interconnected with the rails 24 and 26 in tenon-and-mortise fashion. Specifically, the ear portion 42 of each stile 20 and 22 is fitted within one of the channels 48 in the bottom rail and a similar channel in the top rail. The rails and stiles are adhesively secured so that other fastening means are unnecessary. However, substitute fastening means or additional fastening means can be used as desired. When connected in tenon-and-mortise fashion, the rail ears 46 extend the full distance between the stile ears 42. Consequently, the four ears on the rails and stiles form the continuous lip 30 (FIG. 1) about the entire periphery of the door opening 28.

The stiles and rails are covered in conventional fashion with steel or other protective skins. As illustrated in FIG. 3, the opposite skins 45*a* and 45*b* for the bottom rail 26 are applied to the opposite sides of the door 41*a* and 41*b* respectively. The opposite skins extend inwardly toward one another at fold lines 47 and then parallel to one another at fold lines 49 to follow the contour of and overlie the ear 46. The skins 45*a* and 45*b* terminate at the end of the ear 46. In similar fashion, the two stiles 20 and 22 and the top rail 24 are also covered with protective skins.

II. Glass Panel

The glass 14 (FIGS. 4 and 5) in all embodiments of the invention is insulated glass generally well known to those having ordinary skill in the art. The panel 14 includes a pair of panes 50 and 52 held in spaced relationship by a spacer block 54 extending about the perimeter of the panel 14. Other transparent or translucent panels can be substituted for the double-insulated glass as desired.

As illustrated, the thickness of the glass 14 is equal to the thickness of the lip 30. However, these elements may have different thicknesses as desired. Preferably, the lip 30 is sufficiently thin to permit the frames 16 and 18 to be flush-mounted.

III. First Door-Light Frame Embodiment

The door-light frame and sealing structure according to a first aspect of the invention is illustrated in FIGS. 4–6. Generally speaking, the mounting structure includes an exterior frame 18, an interior frame 16, a lip seal 64, and a panel seal 66. Both frames are flush-mounted with, or slightly recessed from, the opposite door sides 41*a* and 41*b*.

Each of the inner and outer frames 16 and 18 is a single piece of injection-molded material. In the preferred embodiment, the material is a high-heat, high-impact grade, paintable polystyrene such as AMOCO H5M or its equivalent. Such material has relatively low thermal conductivity, eliminating any need for insulation between the two frames.

The exterior frame 18 includes a web portion 70 interconnecting a C-shaped lip-seal portion 72 and a C-shaped panel seal portion 74. The C-shaped seal portion 72 defines a sealant channel or groove 76 extending about the entire periphery of the outer frame 18. Similarly, the C-shaped support portion 74 defines a sealant channel or groove 78 which extends about the entire periphery of the frame 18. A trim flange 80 extends from the C-shaped portion 72 away from the lip 70 and terminates at the body portion 40 of the stile 20. A corner relief 80*a* (see FIG. 4) is provided at each corner so that the trim flanges 80 are not interconnected at the corners.

A sealant 64 is located within the channel 76 to provide a weather seal between the lip 30 and the exterior frame 18. Similarly, a sealant 66 is located within the channel 78 to provide a weather seal between the weather panel 14 and the exterior frame 18. In the preferred embodiment, the sealant is a "foamable gasket" referring to any polymeric material which is applied as a liquid and injected with gas and having a melting point higher than maximum exterior door temperatures of 150 degrees to 175 degrees Fahrenheit. Suitable materials and their . application are described in copending application Ser. No. 088,563, filed Aug. 24, 1987, entitled SKYLIGHT WITH IMPROVED SEAL, and assigned to the assignee of the present application. All of the weather seals preferably used in the various embodiments of the present application releasably engage both the door lip 30 and the glass 14 so that removal of either frame will not leave sealant residue on the lip or glass. Other sealants such as butyl caulk could also be used. Prior to the installation of the frames 16 and 18, the sealant extends outwardly from the channel 76 and 78 to be compressed against the lip 30 and the panel 14, respectively, as the two frames are drawn together.

A screw boss 82 is integrally molded with the web portion 70 at spaced locations about the perimeter of the frame 18 to provide an attachment means for the frames. The screw boss 82 is supported by integral ribs 84 and 86 extending between the boss and the portion 72 and 74, respectively. The screw boss 82 defines a cylindrical bore 88 which is blind and terminates at the web portion 70. The internal diameter of the bore 88 is selected so that screws inserted therein self-tap upon installation.

The interior frame 16 is generally similar to the exterior frame 18 with the exception of the panel-engaging portion 74' and the screw bosses 82'. The web portion 70', the lip-engaging portion 72', the sealant channel 76', the trim flange 80' are all identical to their corresponding parts in the exterior frame 18.

The panel-engaging portion 74' includes a spacer foot 90' which engages the panel 14. A cutout area 92' adjacent the foot 90' provides a void into which a decorative grille can be fitted. Preferably, sealant is not provided in channel 76' or cutout area 92' since weather seals are not required on the interior side of the door.

Screw bosses 82' (FIG. 5) are integrally molded with and generally perpendicular to the web portion 70'. The screw bosses 82' each define a cylindrical bore 88' which is aligned with and communicates with a countersink 94' in the web portion 70'. The diameter of the cylindrical bore 88' is larger than the diameter of the cylindrical bore 88 in the opposite screw boss so that the threaded fasteners will not threadedly engage the screw boss 82'.

Screws 6 are threadedly secured between the bosses 82 and 82' to fasten or intersecure the frames 18 and 16 together. Each screw passes through the boss 82' and threadedly engages the boss 82. The screw head is received within the counterbore 94' in the interior frame 16 to be flush with the web 70'.

Installation of the panel 14 within the door 12 is relatively simple as with any of the frames described in this application. The exterior frame 18 is fitted within the door 12, and these two pieces are then laid on a work surface with the exterior frame facing downwardly. As the exterior frame 18 is positioned, the seal 64 engages the lip 30 and is slightly compressed thereby. Preferably, the door opening 28 and the frame 18 are relatively dimensioned so that the trim flanges 80 engage the rectangular body portions (e.g. 40) of the rails and stiles to be slightly flexed or compressed thereby. Such construction accommodates differential expansion and contraction, for example due to thermal changes, and also permits improved manufacturing tolerances. The corner relief 80*a* permits flexure of the flanges 80 at the corners.

The glass panel 14 is then laid on the exterior frame 18 and within the lip 30. The screw bosses 82 about the periphery of the exterior frame 18 aid in locating the panel 14 within the exterior frame. As the glass 14 is laid on the support portion 74, the panel engages and compresses the seal 66 to form a weather seal therebetween.

The interior frame 16 is fitted within the door 12 and the trim flanges 80' engage the rails and stiles as discussed above in conjunction with flanges 80. The screw bosses 82' of the inner frame 16 are aligned with the screw bosses 82 of the outer frame 18. One screw 92 is inserted through each screw boss 82' and secured within the opposite screw boss 82 to fasten or secure the two frames together. As the screws are tightened, the seals 64 and 66 are compressed to form weather seals between the exterior frame 18 and the lip 30 and the panel 14, respectively. The support portions 72 and 74 bottom out against the lip 30 and the panel 14, respectively. However, the bosses 82 and 82' typically do not engage one another even when the screws are fully tightened.

As can be seen, the frames 18 and 16 sandwich the lip 30 and the panel 14 therebetween as the frames are brought together. Consequently, the panel 14 is retained between the two frames, and the door-light assembly is retained on the lip 30 about the perimeter of the opening. As previously described, the lip 30 extends about the entire perimeter of the opening, and therefore the weather seal between the outer frame 18 and the lip is continuous about the opening.

IV. Second Door-Light Frame Embodiment

A second embodiment of the door-light frame is illustrated in FIGS. 7–11 and generally designated 116 and 118. The second embodiment is mounted in a door 12 having a construction identical to that described in conjunction with the previous embodiment and supports a glass panel 14 also identical to that described in the previous embodiment.

One potential drawback of the previously described embodiment is the creation of a gap between the door sides 41 and the inner and outer frames 18 and 16. Such gap creates a space in which dirt or other particulate matter can accumulate. Further, the gap itself is considered by some to be aesthetically unpleasing. Although every effort is made to eliminate such gap, it may be preferable to utilize the invention of the second and third embodiments which specifically seal or cover this gap.

Each of the second embodiment inner and outer frames 116 and 118 are injection-molded of a single piece of material extending about the entire perimeter of the opening. As illustrated in FIG. 8, the cross-sectional profiles of the inner and outer frames are generally similar to one another.

The inner frame 116 is generally U-shaped in cross section and includes a facing portion 120 and a lip-engaging flange 122 and a panel-engaging flange 124 extending therefrom. The lip-engaging flange 122 terminates in an edge 126 which is compressed toward the lip 30. The panel-engaging flange 124 terminates in a panel-engaging edge 128 which bears against the panel 114 to support the panel within the opening. A cutout or recessed portion 130 is spaced from the panel 114 to define a slot into which a decorative grille can be fitted.

A plurality of screw bosses 132 are integrally molded with the remainder of the frame 116. Each screw boss 132 is generally cylindrical in cross section including a cylindrical throughbore 134 which receives screws as will be described. A counterbore 136 is formed in the facing 120 and communicates with and is aligned with the throughbore 134 to receive screw heads. A pair of ribs 138 and 140 extend from opposite sides of the screw boss 132 to the flanges 122 and 124, respectively to support the screw boss within the frame 116.

As noted above, the outer frame 118 is generally similar to the inner frame 116. The outer frame includes a facing 150, and a lip-engaging flange 152 and a panel-engaging flange 154 extending therefrom. The lip-engaging flange 152 terminates in an edge 156 which bears against the lip 30 about the perimeter of the door-light opening. The panel-engaging flange 154 terminates in a panel-support portion 158 which is generally C-shaped in cross section to define a sealant channel 160. A sealant compound 162 is supported within the sealant channel 160 and in the preferred second embodiment is identical to the sealant compounds previously discussed.

A plurality of screw bosses 164 are integrally molded with the facing 150 and ar positioned to be generally aligned with the screw bosses 132 of the inner frame 116. The screw bosses 164 are generally cylindrical in cross section defining a cylindrical throughbore 166 having a diameter less than that of the throughbore 134 in the mating screw boss. Consequently, screws threadedly engage the throughbore 166 to be self-tapped upon installation. The through bores 166 are blind and do not communicate through the facing 150. A pair of ribs 166 and 168 extend in opposite directions from the screw boss 164 to the flanges 152 and 154, respectively to support the screw boss within the U-shaped cross section of the outer frame 118.

A gap seal 180 is mounted on each of the inner and outer frames 116 and 118 to cover the gap 182 between the rectangular body portion (e.g. 40) of the door 112 and the frames. The gap seal 180 is illustrated in greater detail in FIG. 9 and preferably is a co-extruded gasket. The coextrusion includes a C-shaped channel 184 and a flat body portion 186 of a first relatively high durometer and a stem 188 and barbs 190 and 192 of relatively low durometer. As presently preferred, the material of elements 184 and 186 is rigid polyvinyl chloride having a durometer of approximately 50 shore D; and elements 188, 190, and 192 are fabricated of flexible polyvinyl chloride having a durometer of approximately 70 shore A. Preferably, the material of which the body portion 186 is fabricated is paintable so that all visible surfaces of the door, the frame, and the gap seal can be painted. Of course, other materials having other durometers can be selected depending upon the application. The gap seal is hot-knife welded at each of the four corners of the frame to provide a continuous gasket about the perimeter of the frames.

The C-shaped channel 184 is dimensioned to fit about the edge 156 of the outer frame flange 122 and also about the edge 126 of the inner frame flange 152. A pair of resilient barb flanges 190 extend from opposite sides of the C-shaped body 184 toward one another to be compressed by the frame upon installation. The barb flanges 190 provide a weather seal between the gap seal 180 and the frame 116 or 118. Barb flanges 192 extend at an acute angle from the bottom wall 185 of the C-shaped body 184 to engage and be compressed by the lip 30. The body portion 186 is flat and preferably generally planar to the facing 150. The body 186 includes a beveled rearward edge 194 and a beveled forward edge 196. The beveled edge 194 engages the door 12 to position the body 186 with respect to the door. The beveled surface 196 provides an aesthetically pleasing blend into the facing 150.

The stem portion 188 interconnects the body portion 186 and the rigid cup 184. The gap seal extrusion 180 is illustrated in its relaxed position in FIG. 9. Upon installation within the assembly, the body portion 186 is urged downwardly as viewed in FIG. 9 and consequently flexes and biases the stem portion 188. This retains the outer beveled surface 194 against the door 12 and allows the stem 188 to "float" within the gap 182.

FIGS. 10 and 11 illustrate the frames 116 and 118 in an extreme unaligned position with respect to the door 12. Specifically, the frames 116 and 118 are lower along lip 30 and thereby create a relatively wide gap 182' between the door 12 and the frames. The resiliency of the stem portion 188 maintains the flattened body portion 186 in contact with the door. Further, the width of the flattened body portion 186 is sufficient to extend to and engage the facing portion 150 of the outer frame 118. Thus, the gap seal 180 seals or covers the gap 182, 182' regardless of the width of the gap.

The function of the gap seal 180 in conjunction with the inner frame member 116 is identical to that described in conjunction with the outer frame 118. Consequently, the structure and function of the gap seal on the inner frame member 116 will not be described in detail.

The second embodiment frames 116 and 118 are assembled with the door 12 and panel 14 in a fashion generally similar to that described in conjunction with the first embodiment. The only significant difference is that the gap seals 180 must be installed on the inner and outer frames 116 and 118 prior to their engagement with the lip 30. The centering of the frames within the door opening 28 is not of critical importance since the gap seals 180 will cover the gap 182 regardless of its possible width. The resilient stem portion 188 maintains the body portion 186 aligned with the outer surface of the door 12. Further, the resilient stem portion 188 registers the body portion 186 against the door to provide the desired continuous surface with the frame 118.

The barb seals 190 and 192 effect a weather-tight seal between the frame 118 and the lip 130; and the glazing material 162 provides a weather-tight seal against the glass panel 14. As previously described, the screw bosses 132 and 164 do not bottom out against one another upon tightening. Rather, the entire compressive force supplied by the fasteners is borne by the lip 30 and the panel 14 to provide tight seals between all contact surfaces.

V. Third Door-Light Frame Embodiment

A third embodiment of the interior and exterior frames 216 and 218 is illustrated in FIGS. 12–16. The frames are used to mount a panel 14 within a door 12. Both the door 12 and the panel 14 are identical to those previously described and therefore will not be described in detail. Suffice it to say that the door 12 includes a peripheral lip 30 extending into the door opening about the entire perimeter of the door.

The inner frame 216 is generally similar to the inner frame 116 (see FIG. 8) previously described. The inner frame includes a facing 220, and a lip-engaging flange 222 and a panel-engaging flange 224 extending therefrom. The lip-engaging flange 222 is slightly S-shaped in cross section including an inner portion **222*a* and an outer portion 222*b*. The flange 222 extends away from the rectangular body of the door 12 with increased distance from the lip 30. Consequently, a gap 282 is created between the frame and the door. The remaining components of the inner frame 216 are generally identical to their counterparts in the previously described embodiment 116**.

The exterior frame 218 )FIGS. 12–13) is also generally similar to the exterior frame 118 (see FIG. 8) previously described. The exterior frame includes a facing 250, a lip-engaging flange 252, and a panel-engaging flange 254 extending therefrom and supporting a sealant compound 262 for weather sealing purposes. The lip-engaging flange 252 is slightly S-shaped in cross section including an inner portion **252*a* and an outer portion 252*b*. The lip-engaging flange 252 also extends away from the rectangular door body with increasing distance from the lip 30 to create a gap 282 therebetween. The remaining portions of the exterior frame 218 are generally identical to their corresponding elements in frame 118**.

A gap seal 280 (FIGS. 13–14) is fitted about each of the interior and exterior frames 216 and 218 to both provide a weather seal and seal or cover the gap between the door and the frame. The seal 280 is illustrated in its relaxed position in FIG. 14 and generally includes a J-shaped weather-seal portion 284 and a bulb-seal portion 286. The weather seal portion 284 includes an elongated leg 288 which is connected to the bulb seal 286. The bulb seal is generally circular in cross section in its relaxed state. The gap seal 280 is also hot-knife welded at the four corners of the frame to provide a continuous seal about the periphery of the opening 28.

In the preferred embodiment, the gap seal 280 is extruded of a material having a relatively low durometer such as MONSANTO SANTOPRENE grade 101–64 or 201–64, which has a durometer of approximately 64 shore A. Of course, other materials or even coextrusions could be substituted therefore.

The J-shaped weather seal 284 is fitted about the outer portion **252*b* of the flange 252 to provide a weather seal between the lip engaging flange 252 and the lip 30. The elongated leg 288 has a length generally identical to the length of the outer portion 252*b* such that the bulb seal 286 is located between the inner flange portion 252*a*** and the door body.

As illustrated in FIGS. 12 and 13, the frames 216 and 218 are in one extreme position wherein the bulb seal is compressed to its maximum extent. Even when fully compressed, the exterior-most portion of the bulb seal 286 is still generally coplanar with the outer surface of the door and the facing 252 of the frame 218.

Assembly of the door including the alternate frames 216 and 218 is generally identical to the construction previously described in conjunction with the first embodiment. The primary difference is that the gap seal 280 is fitted about the flanges 222 and 252 on the inner and outer frames 216 and 218, respectively, prior to installation of the frames in the assembly. The relatively low durometer of the gap seal 280 creates a weather seal between the frame 218 and the lip 30. The compressed bulb seal within the gaps 282 and 282' prevents dirt from accumulating within these gaps and provides an aesthetically continuous surface. Presently available materials having the desired durometer for the gap seal 280 are not paintable; and accordingly, the exposed portion of the bulb seal 286 will not retain paint.

The frames 216 and 218 are illustrated in an opposite extreme position with respect to the door 12 in FIGS. 15 and 16. The diameter of the bulb seal 286 is still adequate such that the bulb seal is slightly compressed between the door 12 and the frames 216 and 218. Consequently, the bulb seals 286 continue to cover or seal the gaps 282 and 282' to provide an aesthetically pleasing appearance. It is desirable to minimize the width of the gaps 282 and 282' in view of the unpaintability of the gap seal 280.

The above descriptions are those of preferred embodiments of the invention. Various alternations and changes can be made without departing from the spirit and broader aspects of the invention as set forth in the claims, which are to be interpreted in accordance with the principles of patent law including the doctrine of equivalents.

The embodiments of the invention in which an exclusive property or privilege is claimed are defined as follows:

1. A door assembly comprising:

a door having inner and outer sides and defining an opening, said door including a lip extending into said opening about the entire perimeter of said opening, said lip being recessed from both said inner and outer sides;

a panel; and a frame means for supporting said panel within said opening, said frame means including inner and outer frames and fastening means for fastening said frames together, said inner and outer frames each including a panel-support portion engaging opposite sides of said panel and sandwiching said panel therebetween, said inner and outer frames each including a door-support portion engaging opposite sides of said lip and sandwiching said lip therebetween, said frame means further including panel-sealing means for providing a weather seal between said panel-support portion of one of said frames and said panel, said frame means further including lip-sealing means for providing a weather seal between said door-support portion of one of said frames and said lip, said fastening means extending between said lip and said panel and engaging said inner and outer frames to draw said frames together against said panel and against said lip, both said panel-sealing means and said lip-sealing means being compressed when said frames are drawn together by said fastening means.

2. A door assembly as defined in claim 1 wherein said one frame and the associated door side define a gap therebetween, and further comprising gap-seal means for aesthetically sealing said gap.

3. A door assembly as defined in claim 1 wherein said lip-seal means and said panel-seal means releasably engage said lip and panel respectively.

4. A door assembly as defined in claim 1 wherein each of said inner and outer frames is a single injection-molded piece.

5. A door assembly comprising:

a door having inner and outer sides and defining an opening, said door including a lip extending into said opening about the entire perimeter of said opening, said lip being recessed from both said inner and outer sides;

a panel; and frame means for supporting said panel within said opening, said frame means including inner and outer frames and fastening means for fastening said frames together, said inner and outer frames each including a panel-support portion engaging opposite sides of said panel and sandwiching said panel therebetween, said inner and outer frame each including a door-support portion engaging opposite sides of said lip and sandwiching said lip therebetween, said frame means further including panel-sealing means for providing a weather seal between said panel-support portion of one of said frames and said panel, said frame means further including lip-sealing means for providing a weather seal between said door-support portion of one of said frames and said lip said lip-sealing means comprising a gasket fitted about said door-support portion between said door-support portion and said lip, both said panel-sealing means and said lip-sealing means being compressed when said frames are intersecured by said fastening means.

6. A door assembly as defined in claim 5 wherein said one frame and the associated door side define a gap therebetween, and further comprising gap-seal means for aesthetically sealing said gap.

7. A door assembly as defined in claim 6 wherein said gap-seal means is integral with said lip-seal means.

8. A door assembly as defined in claim 7 wherein said gap-seal means comprises a bulb seal.

9. A door assembly as defined in claim 7 wherein said gap-seal means comprises:

a flat body portion generally coplanar with said associated door side and extending between said one frame and said associated door side and a stem interconnecting said body portion and said lip-seal gasket.

10. A door assembly comprising:

a door having inner and outer sides and defining an opening, said door including a lip extending into said opening about the entire perimeter of said opening, said lip being recessed from both said inner and outer sides;

a panel; and frame means for supporting said panel within said opening, said frame means including inner and outer frames and fastening means for fastening said frames together, said inner and outer frames each being a single injection-molded piece and each including a panel-support portion engaging opposite sides of said panel and sandwiching said panel therebetween, said inner and outer frames each including a door-support portion engaging opposite sides of said lip and sandwiching said lip therebetween, said fastening means including screw bosses integral with said inner and outer frames, said frame means further including panel-sealing means for providing a weather seal between said panel-support portion of one of said frames and said panel, said frame means further including lip-sealing means for providing a weather seal between said door-support portion of one of said frames and said lip, both said panel-sealing means and said lip-sealing means being compressed when said frames are intersecured by said fastening means.

11. A door assembly comprising:

a door having a pair of opposite sides, an opening, and a lip extending into and about the perimeter of the opening, said lip being recessed from each of said door sides;

a panel;

an inner frame including a panel-engagement portion engaging said panel and a lip-engagement portion engaging the lip;

an outer frame including a panel-engagement portion engaging said panel and a lip-engagement portion engaging the lip;

fastener means extending between said lip and said panel and engaging said inner and outer frames for intersecuring and drawing said inner frame and said outer frame together such that the lip is tightly entrapped between said lip-engagement portions of said inner and outer frames, and such that said panel is tightly entrapped and held in place between said panel-engagement portions of said inner and outer frames;

panel-sealing means for providing a weather seal between said outer frame panel-engagement portion and said panel; and lip-sealing means for providing a weather seal between said outer frame lip-engagement portion and lip.

12. A door assembly as defined in claim 11 further comprising gap-seal means carried by said outer frame for sealing any gap between said outer frame and the door.

13. A door assembly as defined in claim 12 wherein said gap-seal means is integral with said lip-sealing means.

14. A door assembly as defined in claim 11 wherein said panel-sealing means comprises a gasket fitted over a portion of said outer frame.

15. A door assembly as defined in claim 14 further comprising gap-seal means carried by said outer frame for sealing any gap between said outer frame and the door, said gap-sealing means being integral with said lip-sealing means.

16. A door assembly as defined in claim 15 wherein said gap-seal means comprises a bulb seal.

17. A door assembly as defined in claim 15 wherein said gap-seal means comprises:

a flat body generally coplanar with said outer frame; and a stem interconnecting said flat body and said lip-sealing means.

18. A door assembly as defined in claim 11 wherein said panel-sealing means and said lip-sealing means releasably engage said panel and the lip respectively.

19. A door assembly as defined in claim 11 wherein both said inner and outer frames are single-piece injection moldings.

20. A door assembly as defined in claim 11 wherein said inner and outer frames each include a fastening portion located intermediately between said panel-engagement and lip-engagement portions, and wherein said fastener means directly engages and extends into said fastening portions of said inner and outer frames.

21. A door assembly as defined in claim 11 wherein the inner and outer frames are each located entirely between planes defined by said opposite sides of said door.

22. A door assembly comprising:

a door having first and second opposite sides and defining an opening, each of said sides defining a plane, said door including a lip extending into said opening about the perimeter of said opening, said lip being recessed from both said first and second sides;

a panel within said opening;

frame means for supporting said panel within said opening, said frame means including inner and outer frames sandwiching said panel and said lip therebetween, each of said frames being entirely positioned between said planes inclusive defined by said door sides, and each of said frames and the associated door side being spaced apart from each other in directions substantially parallel to said planes defined by said door sides such that a gap is defined therebetween;

fastening means extending between said lip and said panel and engaging said inner and outer frames for drawing said frames toward one another and against said lip and said panel; and gap-seal means for filling said gap, whereby visual impact of said gap is reduced.

23. A door assembly as defined in claim 22 further comprising weather-seal means for providing a weather seal between said outer frame and said lip.

24. A door assembly as defined in claim 23 wherein said lip and said panel have thicknesses which are substantially equal.

25. A door assembly as defined in claim 23 wherein said gap-seal means is integral with said weather-seal means.

26. A door assembly as defined in claim 25 wherein said gap-seal means comprises a bulb seal.

27. A door assembly as defined in claim 25 wherein said gap-seal means comprises:

a body extending between said one door side and said associated frame; and a connector portion interconnecting said body and said weather-seal means.

28. A door assembly as defined in claim 22 wherein said gap opens laterally outward and is continuous about the entire perimeter of each of said inner and outer frames.

29. A door assembly comprising:

a pair of stiles each uniform in horizontal cross section and including a rectangular body portion and a rectangular ear portion extending therefrom;

top and bottom rails each uniform in vertical cross section except at opposite ends, each including a rectangular body portion and a rectangular ear portion extending therefrom, each end defining a vertical channel perpendicular to and lying in a common plane with said ear portion, each rail channel receiving one of said stile ear portions to interconnect said stiles and rails to form a polygonal opening having an inwardly extending lip about the perimeter of said opening;

protective skins covering said stile and rail body portions, said protective skins also covering the opposite sides of each ear portion; and a door light including a panel and frame means for mounting said panel within said opening, said frame means including a pair of opposing frame pieces and fastener means for interconnecting said frame pieces and applying forces thereto such that said frame pieces bear against said opposite sides of said ear portions and opposite sides of said panel, said door light further including weather seal means for providing a weather seal between said door light and said protective skins in an area overlying one of the sides of said ear portions.

30. A door assembly as defined in claim 29 wherein a gap exists between said door light and at least some of the rectangular body portions of said stiles and said rails, and further comprising gap-seal means for sealing said gap.

31. A door assembly as defined in claim 30 wherein said gap-seal means is integral with said weather-seal means.

32. A door assembly as defined in claim 29 wherein said stiles and rails each include opposite side surfaces and wherein said frame pieces are positioned substantially entirely between said opposite side surfaces of said stiles and rails.

33. A door assembly comprising:

a pair of opposing vertical stiles each being substantially uniform in horizontal cross-section throughout its height, each stile including a body portion and an ear portion extending away from said body portion toward the ear of the opposing stile;

top and bottom opposing rails each extending between said stiles and having opposite ends, each end defining a vertical channel, each stile ear being fitted within one of said channels in each of said rails, said rails cooperating with said stiles to define therewith an opening, each of said rails further including a body portion and an ear portion extending away from said body portion toward the ear portion of the opposing rail, each of said rail ears extending between said stile ears such that said stile ear portions and said rail ear portions form a continuous lip about the perimeter of said opening; and a door light including a panel, a pair of opposing frame pieces for engaging opposite sides of said continuous lip and said panel, and fastening means for interconnecting said frame pieces and urging them toward one another such that said panel is held in said opening.

34. A door assembly defined in claim 33 wherein each of said stiles and rails include a unitary wooden member including the associated body and ear portions.

35. A door assembly as defined in claim 34 further comprising a protective skin means for covering said stiles and rails, said skin means covering at least part of said body portion and said ear portion on each rail and stile, said skin means being continuous between said body and ear portions.

36. A door assembly as defined in claim 33 wherein said stiles and rails each include a pair of opposite sides, and wherein said door light is positioned entirely between said sides.

37. A door assembly comprising:

a door having inner and outer sides and defining an opening, each of said sides defining a plane, said door further including a lip projecting into said opening and extending about the perimeter of said opening, said lip further being recessed from both said door sides;

a panel received within said opening, said panel defining a peripheral edge, said edge being spaced from said lip to define a tap therebetween;

a frame including inner and outer frame pieces, each said frame piece including a first portion engaging said lip of said door, a second portion engaging said panel, and a medial portion positioned between said first and second portions, said frame pieces being entirely positioned between said planes defined by said door sides; and fastener means interconnecting said medial portions of said frame pieces for securely holding said frame pieces against said door lip and said panel, said fastener means including fastening elements, said fastening elements extending through said gap to engage and interconnect said frame pieces, said fastening elements being threaded and extending at least partially through each of said frame pieces, whereby said panel is held in said opening.

* * * * *

UNITED STATES PATENT AND TRADEMARK OFFICE

CERTIFICATE OF CORRECTION

PATENT NO. : 4,920,718

DATED : May 1, 1990

INVENTOR(S) : Kert E. Artwick et al

It is certified that error appears in the above-identified patent and that said Letters Patent is hereby corrected as shown below:

Column 11, claim 5, line 59:
delete first occurrence of "said lip".

Column 12, claim 9, line 9:
after the word "side" insert --;--.

Column 15, claim 34, line 13:
after the word "assembly" insert --as--.

Column 16, claim 37, line 9:
delete "tap" and insert --gap--.

Signed and Sealed this

Twenty-second Day of October, 1991

*Attest:*

HARRY F. MANBECK, JR.

*Attesting Officer*

*Commissioner of Patents and Trademarks*